US008550177B2

(12) United States Patent
Henckel et al.

(10) Patent No.: US 8,550,177 B2
(45) Date of Patent: Oct. 8, 2013

(54) PACKER ASSEMBLY

(75) Inventors: Michelle Brianne Henckel, Grapevine, TX (US); Beauford Sean Mallory, Sachse, TX (US); Jody Ray McGlothen, Waxahachie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 360 days.

(21) Appl. No.: 13/013,386

(22) Filed: Jan. 25, 2011

(65) Prior Publication Data

US 2012/0186830 A1 Jul. 26, 2012

(51) Int. Cl.
*E21B 33/1295* (2006.01)
*E21B 23/06* (2006.01)

(52) U.S. Cl.
USPC ..... 166/387; 166/125; 166/134; 166/209; 166/212

(58) Field of Classification Search
USPC ..... 166/387, 120, 125, 134, 209, 212, 166/216
See application file for complete search history.

(56) References Cited

U.S. PATENT DOCUMENTS 3,678,998 A * 7/1972 Cockrell et al. ..... 166/123
3,749,167 A * 7/1973 Young ..... 166/217
4,044,826 A * 8/1977 Crowe ..... 166/120
4,156,460 A * 5/1979 Crowe ..... 166/120
4,216,827 A * 8/1980 Crowe ..... 166/120
4,311,195 A * 1/1982 Mullins, II ..... 166/120
4,393,929 A * 7/1983 Akkerman ..... 166/134
4,437,517 A * 3/1984 Bianchi et al. ..... 166/120
4,440,223 A * 4/1984 Akkerman ..... 166/217
4,441,559 A * 4/1984 Evans et al. ..... 166/382
4,457,369 A * 7/1984 Henderson ..... 166/125
5,046,557 A * 9/1991 Manderscheid ..... 166/120
5,377,749 A * 1/1995 Barbee ..... 166/120
5,620,050 A * 4/1997 Barbee ..... 166/278
6,112,811 A * 9/2000 Kilgore et al. ..... 166/134
6,536,532 B2 * 3/2003 Doane ..... 166/387
6,691,788 B1 * 2/2004 Dearing ..... 166/382
6,715,560 B2 * 4/2004 Doane et al. ..... 166/387
7,198,110 B2 * 4/2007 Kilgore et al. ..... 166/387
8,087,458 B2 * 1/2012 Birner ..... 166/120
8,291,989 B2 * 10/2012 Kilgore ..... 166/387
2002/0121379 A1 * 9/2002 Doane ..... 166/382
2002/0121380 A1 * 9/2002 Doane et al. ..... 166/382
2007/0062708 A1 * 3/2007 McGregor et al. ..... 166/385
2011/0056676 A1 * 3/2011 Birner ..... 166/120
2011/0147013 A1 * 6/2011 Kilgore ..... 166/387
2012/0186830 A1 * 7/2012 Henckel et al. ..... 166/387

* cited by examiner

*Primary Examiner* — Jennifer H Gay
(74) *Attorney, Agent, or Firm* — Kilpatrick Townsend & Stockton LLP

(57) ABSTRACT

Packer assemblies capable of providing desired load-bearing performance and of being retrieved from a bore in a subterranean formation are described. A packer assembly can include a wedge that can respond to a force in a downhole direction by un-supporting the slip. The unsupported slip is configured to disengage from a casing string, allowing the packer assembly to be removed from the bore. The wedge can include a collet to allow the wedge to separate from the slip to prevent slip re-setting.

20 Claims, 7 Drawing Sheets

PACKER ASSEMBLY

TECHNICAL FIELD OF THE INVENTION

The present invention relates generally to packer assemblies usable in a bore in a subterranean formation and, more particularly (although not necessarily exclusively), to packer assemblies that are capable of withstanding relatively large load forces and that are retrievable from the bore.

BACKGROUND

Packer assemblies can be used in a wellbore to separate the wellbore into one or more zones. A packer assembly can include a packer element capable of providing an annular seal between a tubing string and a casing string, a slip that can retain the packer assembly in a position by gripping the casing string, a wedge that supports the slip, and a mandrel that provides support to the assembly.

Initially, the slip can be positioned closer to the mandrel such that it is unsupported by the wedge to facilitate running the packer assembly downhole. In a set or operation position, or otherwise after running the packer assembly downhole, the wedge supports the slip toward an inner diameter of the casing string. The slip can grip the inner wall of the casing string to retain the packer assembly in position.

It can be desirable to remove a packer assembly from the wellbore. A packer assembly can be removed after the wedge unsupports the slip. Various techniques have been developed to allow the wedge to unsupport the slip. The techniques include modifying a slip tooth angle and providing a collapsible wedge.

The slip tooth angle can be modified such that a passive angle of the tooth matches an angle on the wedge to allow the slip to be pulled off the wedge easier. Modifying the slip tooth angle, however, can decrease the load bearing capability of the slip and wedge and can result in damage to the casing. It can also result in debris being introduced downhole due to shearing that may be needed to release the wedge from the slip. A collapsible wedge can be made from a material that is not rigid or can include grooves that allow it to collapse downhole to release from supporting the slip. A collapsible wedge, however, may collapse prior to a desired time or debris can settle around the wedge, preventing collapse.

Other techniques include pulling the slip from the wedge, which can result in debris due to sheared metal and can be difficult in view of the outward force applied to the slip by the wedge.

Therefore, packer assemblies are desirable that can provide sufficient load bearing performance and that can be removable from the bore.

SUMMARY

Certain aspects and embodiments of the present invention are directed to packer assemblies capable of providing desired load performance and responding to a force in a downhole direction to disengage from a position to allow the packer assemblies to be retrievable from a bore. In some embodiments, a mandrel can include a groove capable of receiving a load device when the mandrel is in a release position. When the load device is received by the groove, the wedge can be capable of responding to the force in the downhole direction by un-supporting the slip. In some embodiments, the wedge can be configured with a mechanism that prevents or reduces slip re-setting.

One feature relates to a packer assembly capable of being disposed in a bore of a subterranean formation. The packer assembly can include a load device, a wedge, and a mandrel. The wedge can cooperate with the load device to support a slip toward a casing string. The slip can engage the casing string. The mandrel can be moved to a release position. The mandrel can include a groove configured to receive the load device in the release position. The wedge can respond to a force in a downhole direction by un-supporting the slip to allow the slip to disengage from the casing string in the release position.

Another feature relates to a method that includes running a packer assembly into a bore of a subterranean formation. The packer assembly includes a wedge and a mandrel. The wedge cooperates with a load device to support a slip toward a casing string such that the slip engages an inner diameter of the casing string. The method also includes moving the mandrel up-hole to a release position at which a groove in the mandrel receives the load device. The wedge responds to a force in a downhole direction by un-supporting the slip to allow the slip to disengage from the inner diameter of the casing string.

Another feature relates to a packer assembly capable of being disposed in a bore in a subterranean formation. The packer assembly includes a slip and a wedge. The wedge can, in a set or operation position, support the slip toward a casing string to allow the slip to engage an inner diameter of the casing string and support a load on the packer assembly in a downhole direction. The wedge can, in a release position, respond to a force in the downhole direction by allowing the slip to disengage the inner diameter of the casing string.

These illustrative aspects and features are mentioned not to limit or define the invention, but to provide examples to aid understanding of the inventive concepts disclosed in this application. Other aspects, advantages, and features of the present invention will become apparent after review of the entire application.

DETAILED DESCRIPTION

Certain aspects and embodiments of the present invention relate to packer assemblies capable of providing desired load bearing performance and of being retrieved from a bore in a subterranean formation. A packer assembly according to some embodiments can include a wedge that can support a load on the packer assembly in a downhole direction in a set or operation position and respond to a force in a downhole direction by un-supporting the slip in a release position. The unsupported slip is configured to disengage from a casing string, allowing the packer assembly to be removed from the bore. In some embodiments, the wedge is configured to separate from the slip to prevent slip re-setting.

These illustrative examples are given to introduce the reader to the general subject matter discussed here and are not intended to limit the scope of the disclosed concepts. The following sections describe various additional embodiments and examples with reference to the drawings in which like numerals indicate like elements, and directional descriptions are used to describe the illustrative embodiments but, like the illustrative embodiments, should not be used to limit the present invention.

Figure 1:
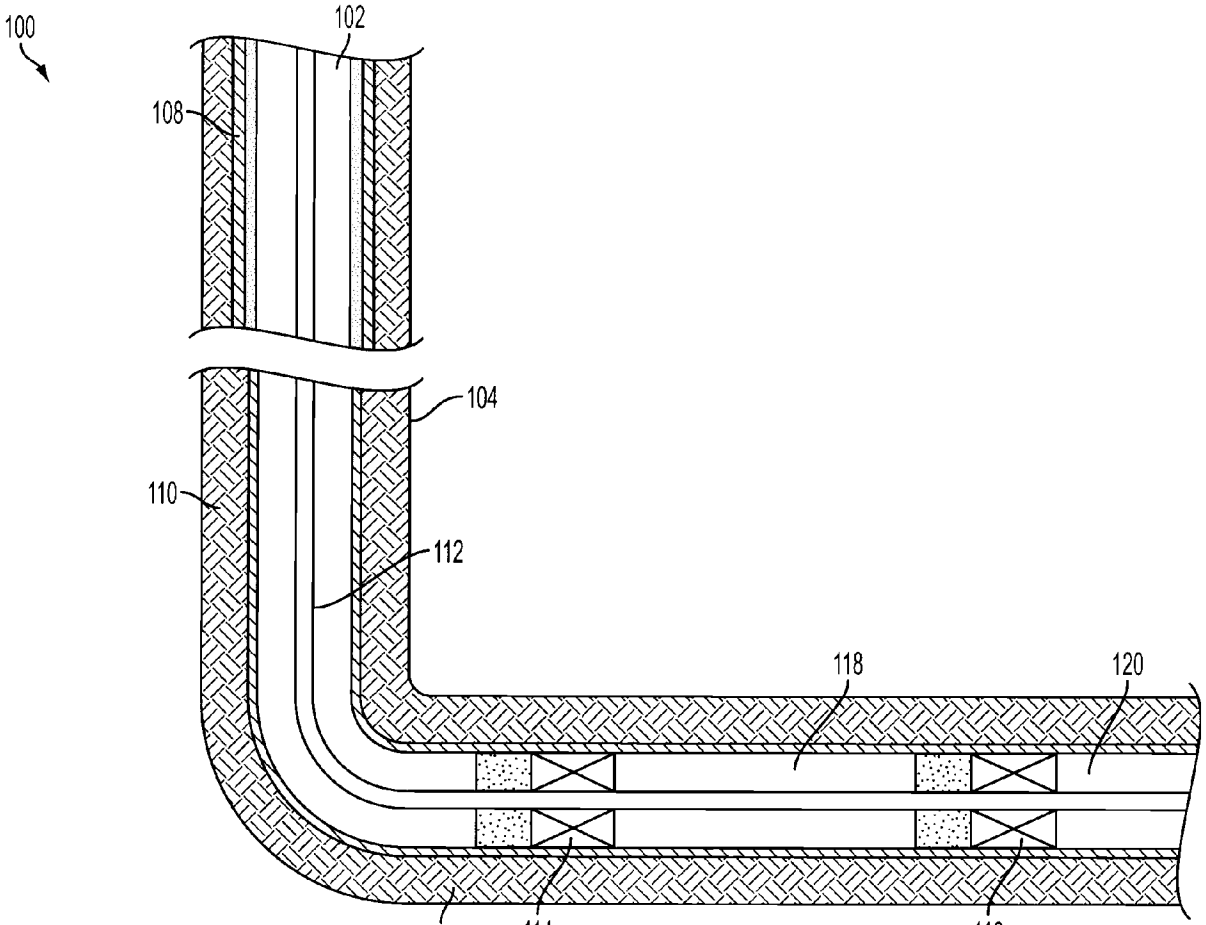
FIG. 1 is a schematic illustration of a well system having packer assemblies according to one embodiment of the present invention.

FIG. 1 depicts a well system 100 with packer assemblies according to certain embodiments of the present invention. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for formation fluids to travel from the substantially horizontal section 106 to the surface. Packer assemblies 114, 116 are positioned with the tubing string 112 in the horizontal section 106. Other components (not shown), such as production tubing, screens, inflow control devices, can be positioned in the wellbore 102. Packer assemblies 114, 116 can provide annular seals between the tubing string 112 and the casing string 108 to define zones 118, 120. One or both packer assemblies 114, 116 can provide desired load performance and be retrievable from the wellbore 102.

Although FIG. 1 depicts packer assemblies 114, 116 positioned in the substantially horizontal section 106, packer assemblies 114, 116 according to various embodiments of the present invention can be located, additionally or alternatively, in the substantially vertical section 104. Furthermore, any number of packer assemblies, including one, can be used. In some embodiments, packer assemblies 114, 116 can be disposed in simpler wellbores, such as wellbores having only a substantially vertical section.

Figure 2A:
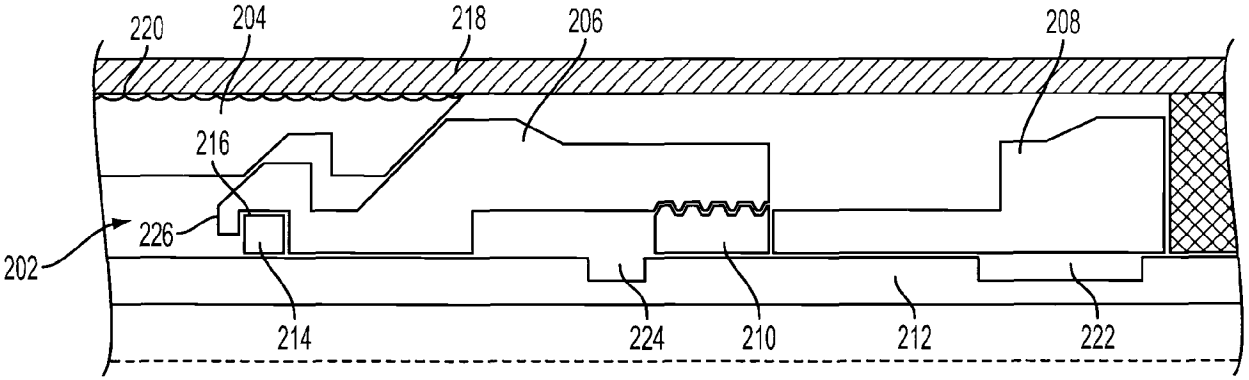
FIG. 2A is a partial cross-sectional view of a packer assembly in a set or operation position according to one embodiment.
Figure 2B:
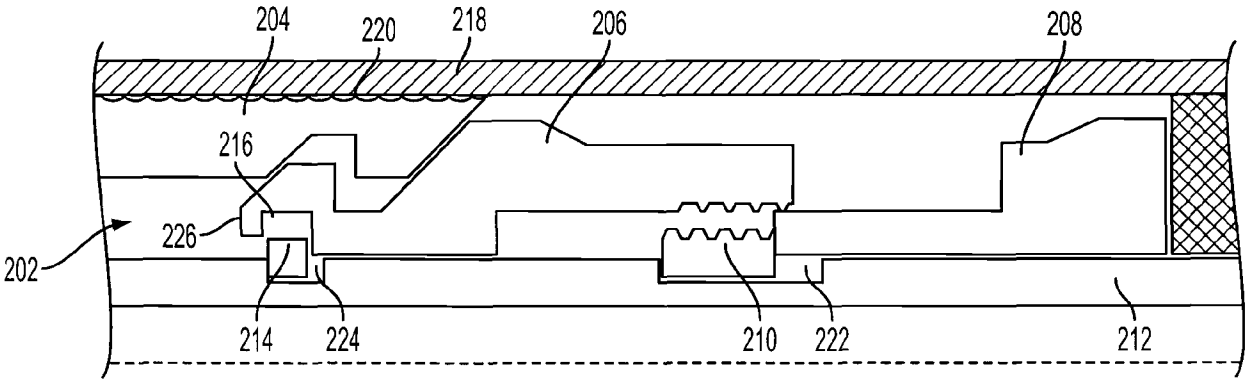
FIG. 2B is a partial cross-sectional view of the packer assembly of FIG. 2A in a first release position according to one embodiment.
Figure 2C:
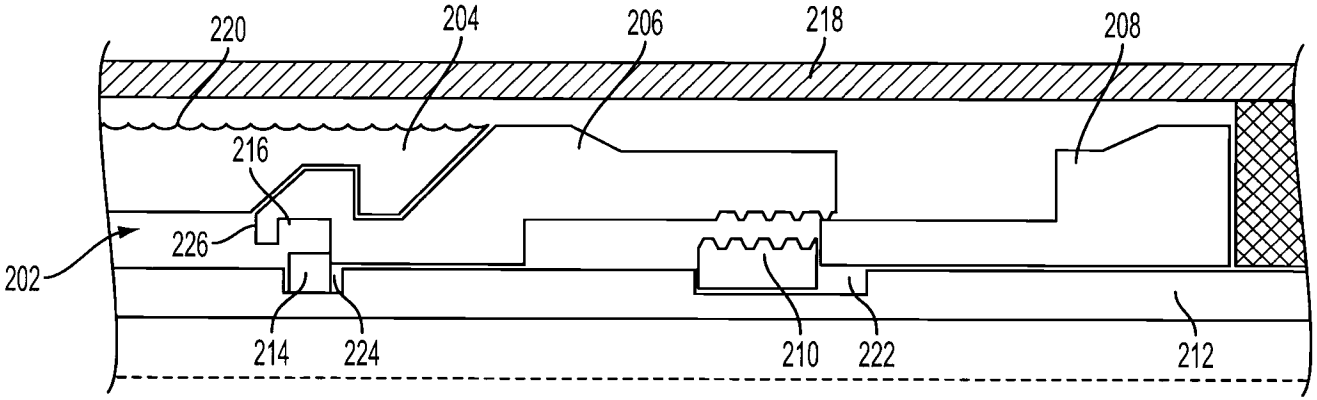
FIG. 2C is a partial cross-sectional view of the packer assembly of FIG. 2A in a second release position according to one embodiment.

Various types of packer assemblies can be used, including packer assemblies capable of disengaging from a casing string after experiencing a force in the same direction as load bearing forces that the packer assemblies are configured to support. FIGS. 2A-2C depict a partial cross-sectional view of a packer assembly 202 according to one embodiment. The packer assembly 202 includes a slip 204, a wedge 206, an element support 208, a load device 210, and a mandrel 212. The packer assembly 202 can also include a device 214 that is capable of being disposed in a wedge groove 216 of the wedge 206. The mandrel 212 can support the wedge 206 in a radial direction at least partially through the device 214. The device 214 may be any component that is at least partially rigid. Examples of device 214 include (but are not limited to) a snap ring, a set of lugs, a load ring, a collet, a pin, and a body lock.

FIG. 2A depicts the packer assembly 202 in a set or operation position after the packer assembly 202 has been run downhole. In the set or operation position, the wedge 206 supports the slip 204 toward a casing string 218. The slip 204 includes teeth 220 capable of gripping an inner diameter of the casing string 218 to retain the packer assembly 202 in position downhole. The wedge 206 is supported by the element support 208 through load device 210. For example, the wedge 206 can cooperate with the element support 208 and load device 210 to support the slip 204 toward the casing string 218. In some embodiments, the load device 210 cooperates with the wedge 206 by being releasably coupled to the wedge 206 and by rigidly providing support from the element support 208 to the wedge 206. A portion of the mandrel 212 can support the load device 210. Load device 210 may be any device capable of supporting the wedge 206. Examples of load device 210 include (but are not limited to) a load ring, a snap ring, set of lugs, a collet, a pin, and a body lock. The packer assembly 202 in the set or operation position can be capable of bearing loads exhibiting a downhole force on the packer assembly 202.

The mandrel 212 can allow hydrocarbon fluid to flow from a hydrocarbon-bearing formation to a conduit defined by a tubing string. In some embodiments, the mandrel 212 is an integrated part of a tubing string. In other embodiments, the mandrel 212 is separate from, but rigidly coupled to, the tubing string. In the set or operation position, the mandrel 212 can support the load device 210 and the device 214. After operation, the mandrel 212 is capable of being cut or sheared during retrieval initiation and pulled up.

The mandrel 212 in FIGS. 2A-2C includes a first groove 222 and a second groove 224. In a first release position as depicted in FIG. 2B after retrieval initiation, the mandrel 212 can be moved up-hole to a position with respect to the other components of the packer assembly 202 such that the first groove 222 receives the load device 210 and the second groove 224 receives the device 214.

When the load device 210 is received by the first groove 222, the wedge 206 is at least partially unsupported in a downhole direction by the load device 210 and the element support 208. In some embodiments, the wedge 206 is completely unsupported. When the device 214 is received by the second groove 224, the wedge 206 is at least partially unsupported in a radial direction.

In some embodiments, the wedge groove 216 is configured to allow the device 214 received in the second groove 224 to be removed from overlapping the wedge 206. For example, the device 214 in the second groove 224 can be moved from under the wedge 206 to a position that is not under the wedge 206. In some embodiments, the wedge groove 216 can be defined by an end 226 that does not extend to the mandrel 212 such that the device 214 in the second groove 224 can be removed from overlapping the wedge 206.

After moving the mandrel 212 up-hole, a load can be applied to the tubing string to move the mandrel 212 downhole to a second release position, as depicted in FIG. 2C. Moving the mandrel 212 downhole can cause the device 214 to apply a force in a downhole direction on at least part of the wedge 206, such as a wall defining an opposite end of the wedge groove 216. The force can cause the wedge 206 to move downhole and un-support the slip 204. In some embodiments, the wedge 206 is capable of moving 1 to 1.5 inches downhole. The unsupported slip 204 can disengage from the inner diameter of the casing string 218 to allow the packer assembly 202 to be retrieved from the bore by pulling the mandrel 212 from the bore.

Although FIGS. 2A-2C depict wedge groove 216 as having a configuration such that end 226 does not extend to the mandrel 212, wedge grooves according to other embodiments can have different configurations. For example, the end 226 may extend to the mandrel 212 or the opposite wall may not extend to the mandrel 212. Furthermore, although wedge groove 216, first groove 222 and second groove 224 have been described as grooves, other configurations are also possible. For example, one or more of these grooves may be slits, cuts, slots, ruts, notches, or indentations.

Figure 3A:
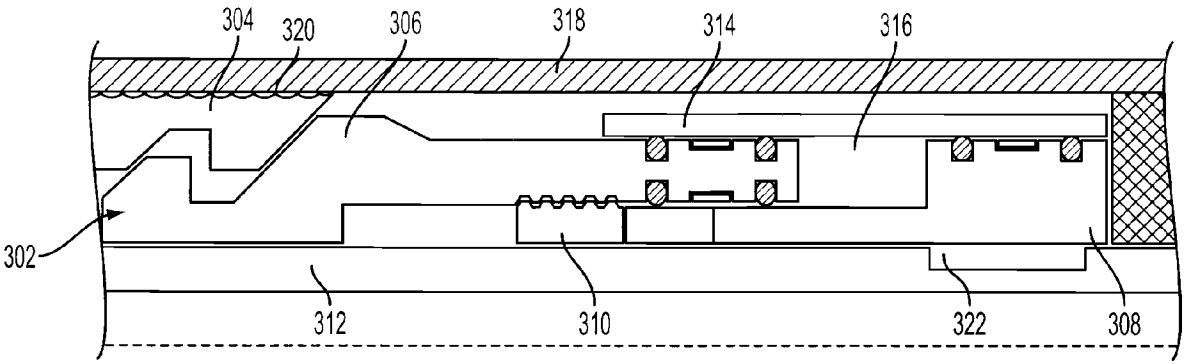
FIG. 3A is a partial cross-sectional view of a packer assembly having a hydrostatic cylinder in a set or operation position according to one embodiment.
Figure 3B:
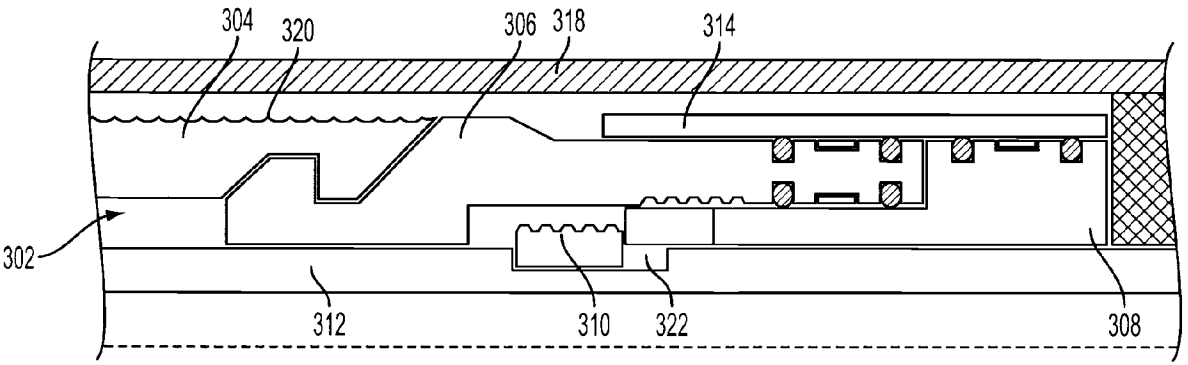
FIG. 3B is a partial cross-sectional view of the packer assembly of FIG. 3A in a release position according to one embodiment.

FIGS. 3A-3B depict cross-sectional partial views of a packer assembly 302 according to a second embodiment. The packer assembly 302 includes a slip 304, a wedge 306, an element support 308, a load device 310, and a mandrel 312. The packer assembly 302 also includes a hydrostatic cylinder 314 capable of creating an atmospheric chamber 316 between the wedge 306 and at least part of the element support 308 such that at least part of the wedge 306 is a hydrostatic piston.

In a set or operation position as depicted in FIG. 3A, the wedge 306 supports the slip 304 toward a casing string 318. The slip 304 includes teeth 320 capable of gripping the casing string 318 to retain the packer assembly 302 in position downhole. The mandrel 312 supports the load device 310, which supports the load created by the hydrostatic cylinder 314 and atmospheric chamber 316.

After operation, the mandrel 312 can be cut or sheared during retrieval initiation and pulled up-hole, towards the surface. The mandrel 312 includes a groove 322 that is capable of receiving the load device 310. As the mandrel 312 is pulled up-hole, the groove 322 aligns with load device 310 and receives load device 310, as depicted in FIG. 3B. When the load device 310 is received in the groove 322, the wedge 306 is unsupported. Downhole pressure, which is greater than the pressure in the atmospheric chamber 316, can exhibit a force on the wedge 306 in the downhole direction. The unsupported wedge 306, as shown in FIG. 3B, can respond to the force in the downhole direction by moving downhole towards a portion of the element support 308 and collapse or otherwise decreasing the volume of the atmospheric chamber 316. When the wedge 306 moves downhole, the wedge 306 can un-support the slip 304. The unsupported slip 304 can disengage from the casing string 318 and the packer assembly 302 can be removed from the bore.

In other embodiments, a spring is provided, alternatively or additionally to the atmospheric chamber 316. For example, the spring can be positioned between the wedge 306 and a portion of the element support 308 and configured to bias the wedge 306 until the load device 310 un-supports the wedge 306.

Packer assemblies according to some embodiments can include wedges that are configured to prevent slip re-setting, particularly if a load is set down on the packer assemblies subsequent to retrieval initiation. FIGS. 4A-4F depict a packer assembly 402 according to one embodiment that is capable of preventing slip re-setting. Although packer assembly 402 is shown and described independently, it should be understood that the features in FIGS. 4A-4F can be applied to the embodiments discussed with reference to FIGS. 2A-2C and 3A-3B.

Figure 4A:
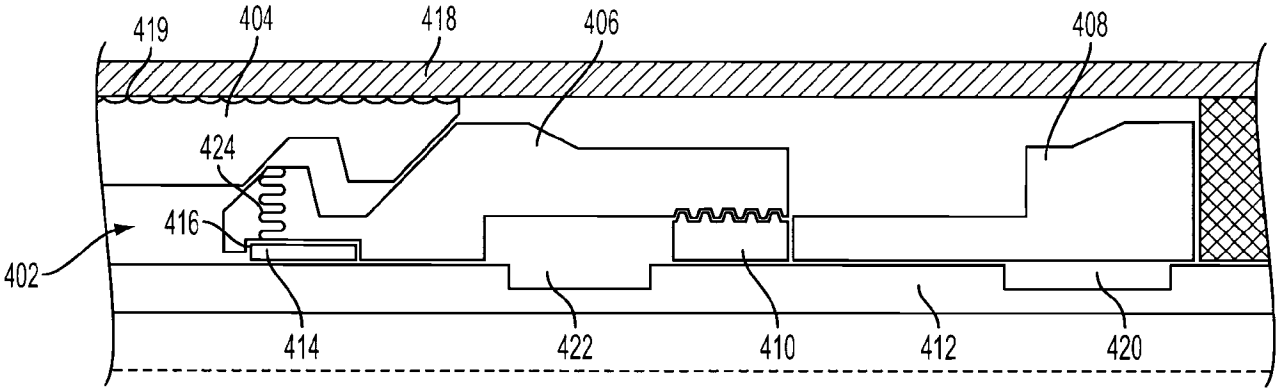
FIG. 4A is a partial cross-sectional view of a packer assembly capable of preventing slip re-setting in a set or operation position according to one embodiment.

Packer assembly 402 includes a slip 404, a wedge 406, an element support 408, a load device 410, and a mandrel 412. The wedge 406 can support the slip 404 toward a casing string 418 in a set or operation position, as depicted in FIG. 4A. The slip 404 can include teeth 419 capable of gripping an inner wall of the casing string 418 to retain the packer assembly 402 in position downhole.

The packer assembly can include a supporting device 414 that can be positioned in a wedge groove 416. The mandrel 412 can support the wedge 406 through supporting device 414. Supporting device 414 may be any device that is capable of cooperating with the mandrel 412 to support the wedge 406. Examples of supporting device 414 include (but are not limited to) a support ring, a sleeve, a load ring, a snap ring, a set of lugs, a pin, a collet, and a body lock.

The mandrel 412 includes a first groove 420 and a second groove 422. The first groove 420 is capable of receiving the load device 410. The second groove 422 is capable of receiving the supporting device 414.

Figure 4B:
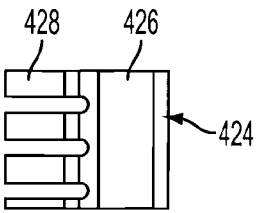
FIG. 4B depicts a collet for a wedge of the packer assembly of FIG. 4A according to one embodiment.

The wedge 406 includes a collet 424. FIG. 4B depicts a collet 424 according to one embodiment that includes a body portion 426 and fingers 428 extending from the body portion 426. The supporting device 414 can support the collet 424 in the set or operation position.

Figure 4C:
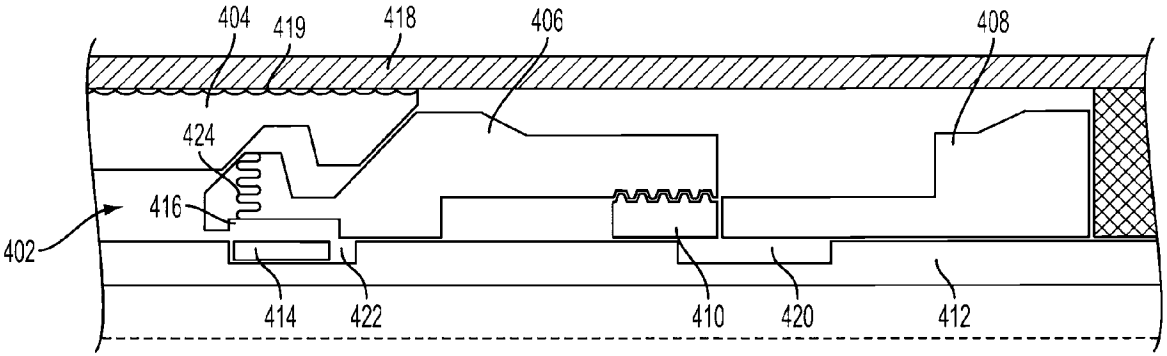
FIG. 4C is a partial cross-sectional view of the packer assembly of FIG. 4A in a first release position according to one embodiment.

After the mandrel 412 is cut or sheared during retrieval initiation, the mandrel 412 is pulled up-hole to a first release position at which the second groove 422 receives the supporting device 414, as shown in FIG. 4C. When the supporting device 414 is received in the second groove 422, the portion of the wedge 406 including the collet 424 is unsupported and is capable of disengaging.

Figure 4D:
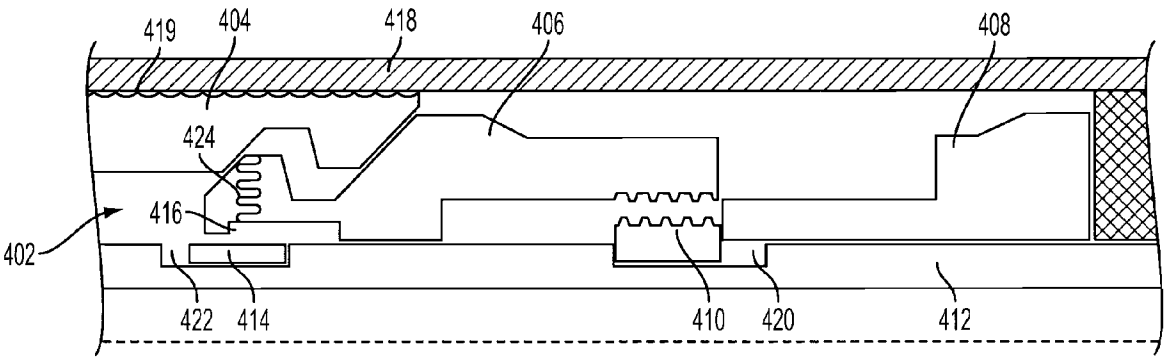
FIG. 4D is a partial cross-sectional view of the packer assembly of FIG. 4A in a second release position according to one embodiment.

The mandrel 412 can be pulled up-hole to a second release position, as depicted in FIG. 4D. In the second release position, the load device 410 is received in the first groove 420 of the mandrel 412. When the load device 410 is received in the first groove 420, the wedge 406 is unsupported by the element support 408 in a downhole direction. The unsupported wedge 406 can allow the slip 404 to disengage from the casing string 418.

Figure 4E:
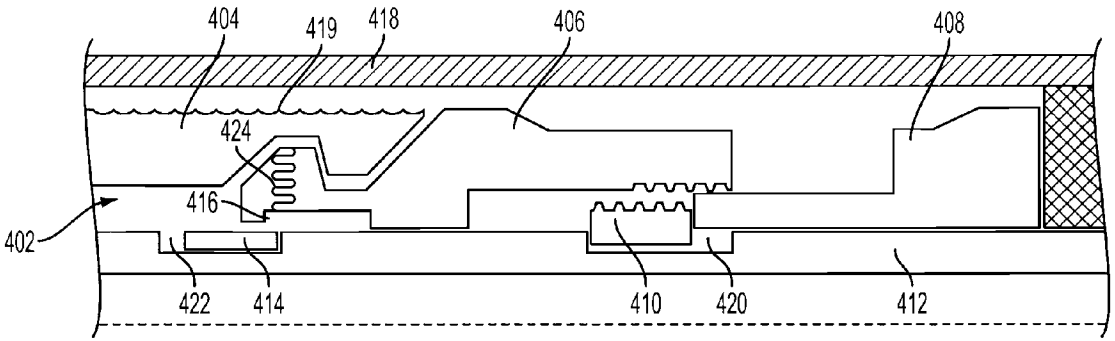
FIG. 4E is a partial cross-sectional view of the packer assembly of FIG. 4A in a third release position according to one embodiment.

The mandrel 412 can be pulled up-hole to a third release position, as depicted in FIG. 4E. At the third release position, the slip 404 can be pulled up-hole using lugs or other suitable components. As the slip 404 is pulled up-hole, the collet 424 can disengage or flex to allow the slip 404 to separate from the wedge 406.

Figure 4F:
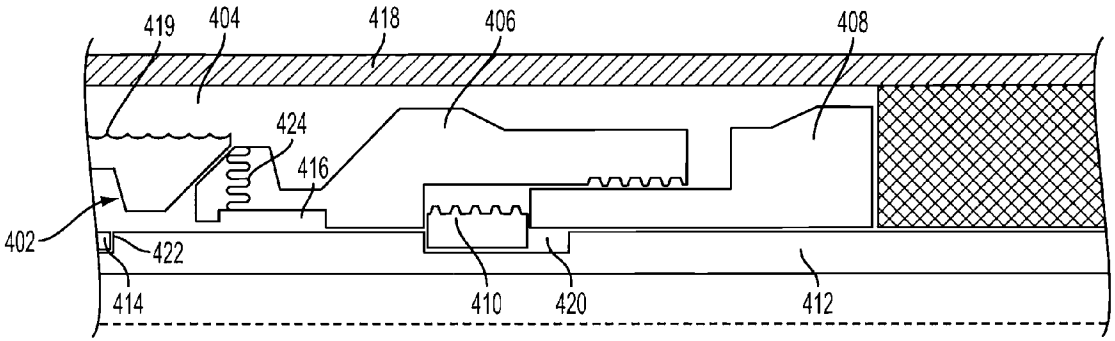
FIG. 4F is a partial cross-sectional view of the packer assembly of FIG. 4A in a fourth release position according to one embodiment.

The mandrel 412 can be pulled up-hole to a fourth release position, as depicted in FIG. 4F, to separate completely the slip 404 from the wedge 406. Separating the slip 404 completely from the wedge 406 can include moving the slip 404 up-hole such that the slip 404 does not overlap with the wedge 406. Separating the slip 404 from the wedge 406 can prevent or reduce re-setting should a load be set down on the packer assembly 402. In other embodiments, the wedge 406 is made from two portions that are capable of being sheared from each other to allow the wedge 406 to separate from the slip 404.

Although packer assembly 402 is depicted as having the supporting device 414, packer assemblies according to other embodiments do not use a supporting device. For example, an outer diameter of a mandrel can be enlarged in certain portions of the mandrel to provide support to a collet portion of a wedge and/or reduced in certain other portions that can un-support the collet portion.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A packer assembly capable of being disposed in a bore of a subterranean formation, the packer assembly comprising:

a load device;

a wedge capable of cooperating with the load device to support a slip toward a casing string, the slip being configured to engage the casing string, the wedge being adapted for supporting a load force in a downhole direction that is toward an end of the bore in the subterranean formation away from a surface of the bore; and a mandrel capable of being moved to a release position, the mandrel comprising a groove configured to receive the load device in the release position, wherein the wedge, in the release position, is capable of responding to a force in the downhole direction by un-supporting the slip to allow the slip to disengage from the casing string.

2. The packer assembly of claim 1, further comprising:

a device capable of being disposed in a wedge groove of the wedge, wherein the mandrel comprises a second groove capable of receiving the device in the release position, wherein the device is capable of applying the force in the downhole direction to at least part of the wedge when the mandrel is in a second release position.

3. The packer assembly of claim 2, wherein the wedge groove comprises an end configured to allow the device to be removed from overlapping the wedge.

4. The packer assembly of claim 2, wherein the device comprises a snap ring and the load device comprises a load ring.

5. The packer assembly of claim 1, further comprising:

an element support capable of cooperating with the load device to support the wedge.

6. The packer assembly of claim 1, further comprising:

a hydrostatic cylinder configured to provide an atmospheric chamber between the wedge and an element support, wherein the force in the downhole direction comprises a downhole pressure capable of causing the wedge to collapse at least part of the atmospheric chamber in the release position.

7. The packer assembly of claim 1, wherein the wedge comprises a collet capable of being unsupported in the release position to allow the wedge to separate from the slip.

8. The packer assembly of claim 7, further comprising:

a supporting device capable of being disposed in a wedge groove and supporting the collet, wherein the mandrel comprises a second groove capable of receiving the supporting device in the release position to un-support the collet.

9. The packer assembly of claim 1, wherein the packer assembly is capable of being retrieved from the bore subsequent to the slip disengaging from the casing string.

10. A method comprising:

running a packer assembly into a bore of a subterranean formation, the packer assembly comprising (i) a wedge cooperating with a load device to support a slip toward a casing string such that the slip engages an inner diameter of the casing string and (ii) a mandrel, the wedge supporting a load force in a downhole direction that is toward an end of the bore of the subterranean formation away from a surface of the bore; and moving the mandrel up-hole to a release position at which a groove in the mandrel receives the load device, wherein the wedge responds to a force in the downhole direction by un-supporting the slip to allow the slip to disengage from the inner diameter of the casing string and allow the packer assembly to be retrieved from the bore.

11. The method of claim 10, wherein moving the mandrel up-hole to the release position comprises moving the mandrel such that a second groove in the mandrel receives a device disposed in a wedge groove of the wedge, the method further comprising:

moving the mandrel downhole to a second release position to apply the force in the downhole direction on the wedge through the device.

12. The method of claim 10, further comprising:

removing the packer assembly from the bore.

13. The method of claim 10, further comprising:

moving the mandrel up-hole to a second release position to un-support a collet in the wedge;

engaging the slip; and moving the slip up-hole to separate the slip from the wedge.

14. The method of claim 10, wherein moving the mandrel up-hole to the release position comprises allowing the force comprising a downhole pressure to move the wedge downhole to collapse at least part of an atmospheric chamber.

15. A packer assembly capable of being disposed in a bore in a subterranean formation, the packer assembly comprising:

a slip; and a wedge capable of, in a set or operation position, (i) supporting the slip toward a casing string to allow the slip to engage an inner diameter of the casing string and (ii) supporting a load on the packer assembly providing a load force in a downhole direction that is toward an end of the bore in the subterranean formation away from a surface of the bore, wherein the wedge is capable of, in a release position, responding to a force in the downhole direction by allowing the slip to disengage the inner diameter of the casing string and allowing the packer assembly to be retrieved.

16. The packer assembly of claim 15, wherein the packer assembly is retrievable from the bore subsequent to the wedge being in the release position.

17. The packer assembly of claim 15, further comprising:

a load device capable of cooperating with an element support to support the wedge in the set or operation position; and a mandrel comprising a groove capable of receiving the load device in the release position, wherein the load device received in the groove is capable of un-supporting the wedge.

18. The packer assembly of claim 17, further comprising:

a device disposed in a wedge groove of the wedge, wherein the mandrel comprises a second groove capable of receiving the device in the release position;

wherein the mandrel is capable of being moved to a second release position to apply the force in the downhole direction to the wedge through the device.

19. The packer assembly of claim 17, further comprising:

a hydrostatic cylinder configured to provide an atmospheric chamber between the wedge and the element support, wherein the force in the downhole direction comprises a downhole pressure capable of causing the wedge to collapse at least part of the atmospheric chamber in the release position.

20. The packer assembly of claim 17, wherein the wedge comprises a collet capable of being unsupported in the release position to allow the wedge to separate from the slip.

* * * * *